United States Patent [19]

Crapser et al.

[11] Patent Number: 4,679,713

[45] Date of Patent: Jul. 14, 1987

[54] VALVE ACTUATOR

[75] Inventors: James R. Crapser; Edward J. Malek, both of Racine County, Wis.

[73] Assignee: S. C. Johnson & Son, Inc., Racine, Wis.

[21] Appl. No.: 724,390

[22] Filed: Apr. 18, 1985

[51] Int. Cl.[4] ..... B65D 83/14

[52] U.S. Cl. ..... 222/402.13; 222/402.14

[58] Field of Search ..... 222/182, 402.1, 402.13, 222/402.14, 402.15, 503, 505, 509, 519-520, 153

[56] References Cited

U.S. PATENT DOCUMENTS

| | | | |
|---|---|---|---|
| 3,185,350 | 5/1965 | Abplanalp et al. | 222/402.14 X |
| 3,414,171 | 12/1968 | Grisham et al. | 222/402.14 |
| 3,519,173 | 7/1970 | Sagarin | 222/402.13 |
| 4,092,974 | 6/1978 | Zenzaburo | 222/402.14 X |
| 4,187,963 | 2/1980 | Mascia | 222/402.13 |
| 4,428,509 | 1/1984 | Emerson et al. | 222/153 |

*Primary Examiner*—Joseph J. Rolla
*Assistant Examiner*—Michael S. Huppert

[57] ABSTRACT

A valve actuator for use with an aerosol container comprises a cap mountable on the discharge end of the container and having an operating member movable to effect opening of a normally closed valve carried by the container and an actuator device arranged for movement relative to the cap and having a surface for engaging the operating member as the actuator device is moved from a first position to a second position so that the operating member remains in valve opening position so long as the actuator device is in the second position. A trigger is provided on the actuator device or the operating member for controlling the operating member when the actuator means is in the first position.

14 Claims, 14 Drawing Figures

VALVE ACTUATOR

BACKGROUND OF THE INVENTION

1. Field of the Invention

This invention relates to valve actuators and, more particularly, to such actuators as are employed with aerosol containers to control discharge of the contents thereof.

2. Description of the Prior Art

There are presently available a number of types of aerosol packages, some of which are intended for intermittent or on demand discharge in upright or inverted position and some of which are designed for continuous discharge. There are also available aerosol packages useful for either on demand or continuous discharge; and it will be appreciated that a number of valve actuating mechanisms have been developed to operate the valves constituting an element of the aerosol packages according to the particular application desired. Examples of such valve actuators are found in U.S. Pat. Nos. 3,006,510 and 3,149,761.

SUMMARY OF THE INVENTION

We have conceived, and contribute by the present invention, a valve actuator for use with an aerosol container and by which we are able to effect two modes of discharge operation, that is, intermittent or on demand discharge, or continuous discharge, by means of a simple, inexpensive and reliable structure.

For attaining the objectives mentioned, we provide a valve actuator of the type described which includes a valve operating member and actuator means which is movable between two positions relative to the operating member and which is provided with structural features that enable the user to effect on demand operation of the discharge valve carried by the container when in one position and continuous operation when in a second position.

Thus, according to one aspect of the invention, we provide a cap mountable on the discharge end of an aerosol container and having a movable operating member adapted to shift a valve member carried by the container from normal valve closed position to valve open position to allow discharge of the container contents. A valve actuator includes actuator means supported exterior of the cap for movement relative thereto and having a surface for engaging and operating the operating member as the actuator means is moved from a first to a second position, whereby the operating member remains in valve opening position so long as the actuator means is in the second position.

The actuator means may take the form of an overcap mounted for rotation relative to the cap about the longitudinal axis of the container and a surface on the overcap may be inclined relative to an operating member to cam the same into valve opening position when the overcap is moved from the first to the second position, and to release the operating member when the overcap is returned to the first position.

In a preferred form of the invention, the operating member includes a manually operable trigger for moving the valve operating member to valve open position, when the overcap is in the first position, the trigger being accessible through an opening in the overcap and taking the form of a button integral with the operating member.

In another form of the invention, the manually operable trigger may be formed on the overcap for shifting the operating member into valve operating position when the overcap is in the first position. In this case, the trigger takes the form of a lever pivotally mounted to the overcap for engagement with the operating member when the overcap is in the first position. Thus, in either form of the invention, intermittent or on demand operation may be realized.

We prefer that the cap and overcap be frictionally engaged so that relative rotational movement of one with respect to the other may be simply and easily effected. To this end, we provide mating surfaces in the form of upstanding annular walls on the cap and overcap which walls may engage frictionally to maintain the same in assembled condition while allowing relative rotational movement therebetween.

The operating member is also formed with means in the form of a central aperture for frictionally supporting a nozzle adapted to engage a valve stem carried by the container so as to receive and control discharge of the container contents when the valve is open.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

DESCRIPTION OF THE DRAWINGS

Specific embodiments of the invention have been chosen for purposes of illustration and description, and are shown in the accompanying drawings, forming a part of the specification wherein.

DETAILED DESCRIPTION OF ILLUSTRATED EMBODIMENTS

Figure 1:
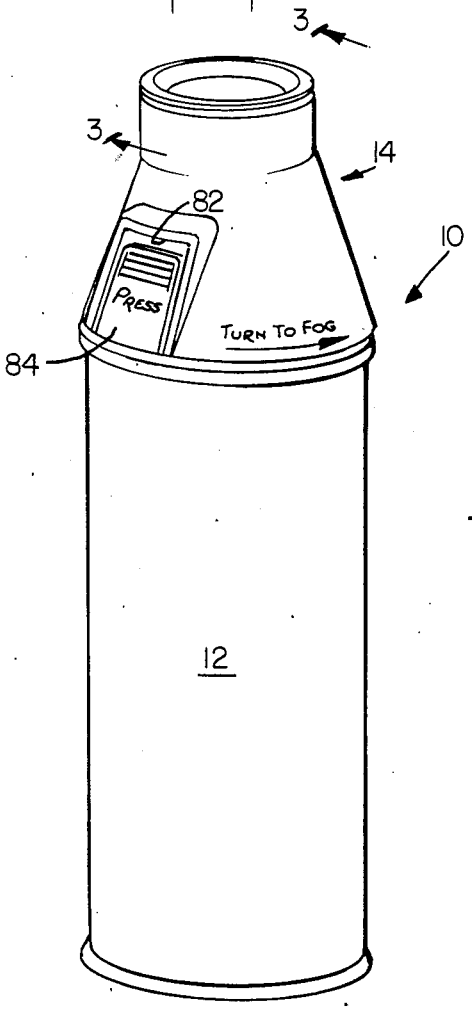
FIG. 1 is an elevational view of a valve actuator according to the present invention illustrated in association with a container for controlling the discharge of the container contents.
Figure 1:
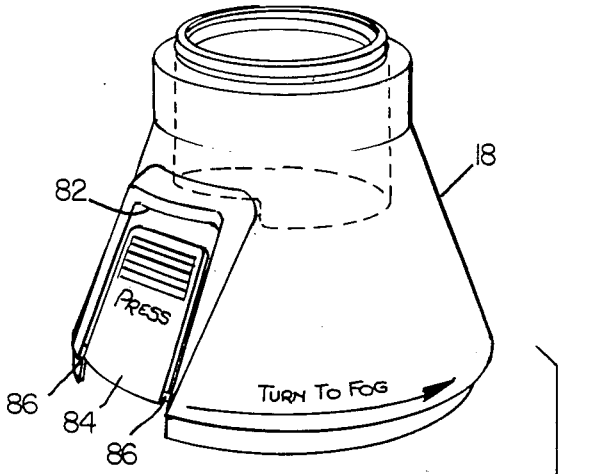
Figure 6:
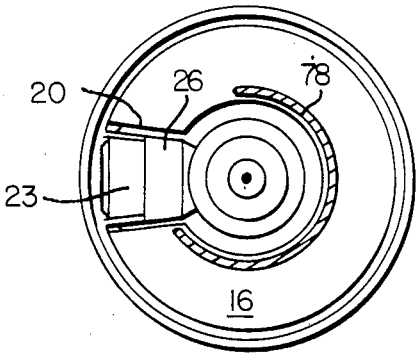
FIG. 6 is a top plan view of the cap (on a relatively slightly reduced scale relative to FIG. 2) and illustrating in cross-section a portion of the overcap in one position relative to the cap.
Figure 7:
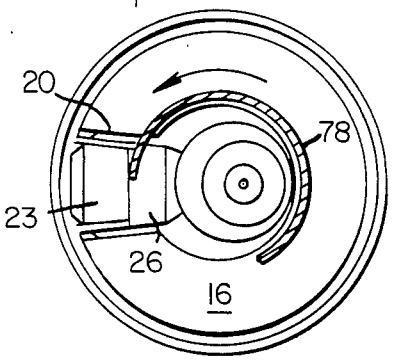
FIG. 7 is a view similar to FIG. 6 but illustrating the portion of the overcap in a second position relative to the cap.

Referring now more particularly to FIG. 1 of the drawing, there is shown an aerosol package 10 comprising a container 12 and a valve actuator 14 of the present invention mounted atop the container 12. The actuator 14 is constituted by a cap 16, (FIGS. 2, 6 and 7) mountable on the container 12 and an overcap 18 (FIG. 2) mountable on the cap 16, both the cap 16 and the overcap 18 being preferably formed of a semi-rigid plastic.

Figure 2:
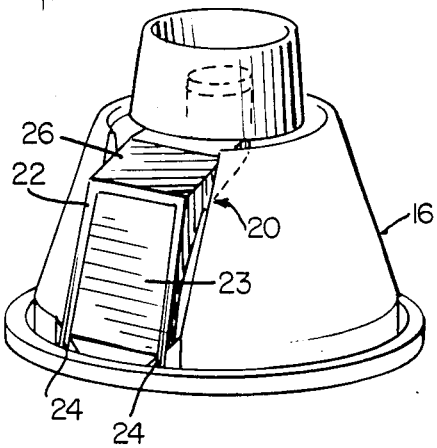
FIG. 2 is an exploded view illustrating the cap and overcap (on a relatively slightly enlarged scale relative to FIG. 1)

The cap 16 is generally conical in form and is provided with a recess 20 extending from its upper rim downwardly to a region near its lower rim, as shown in FIG. 2, and an operating member 22 having a first surface 23 pivotally mounted to the lower region of the cap by integral hinges 24, for example, so that it may be pivoted inwardly relative to the body of the cap 16 upon the application of a radial force thereto, the semi-rigid nature of the cap and hinges 24 being such that an inherent resiliency returns the operating member to its normal position when the operating force is relieved.

Figure 3:
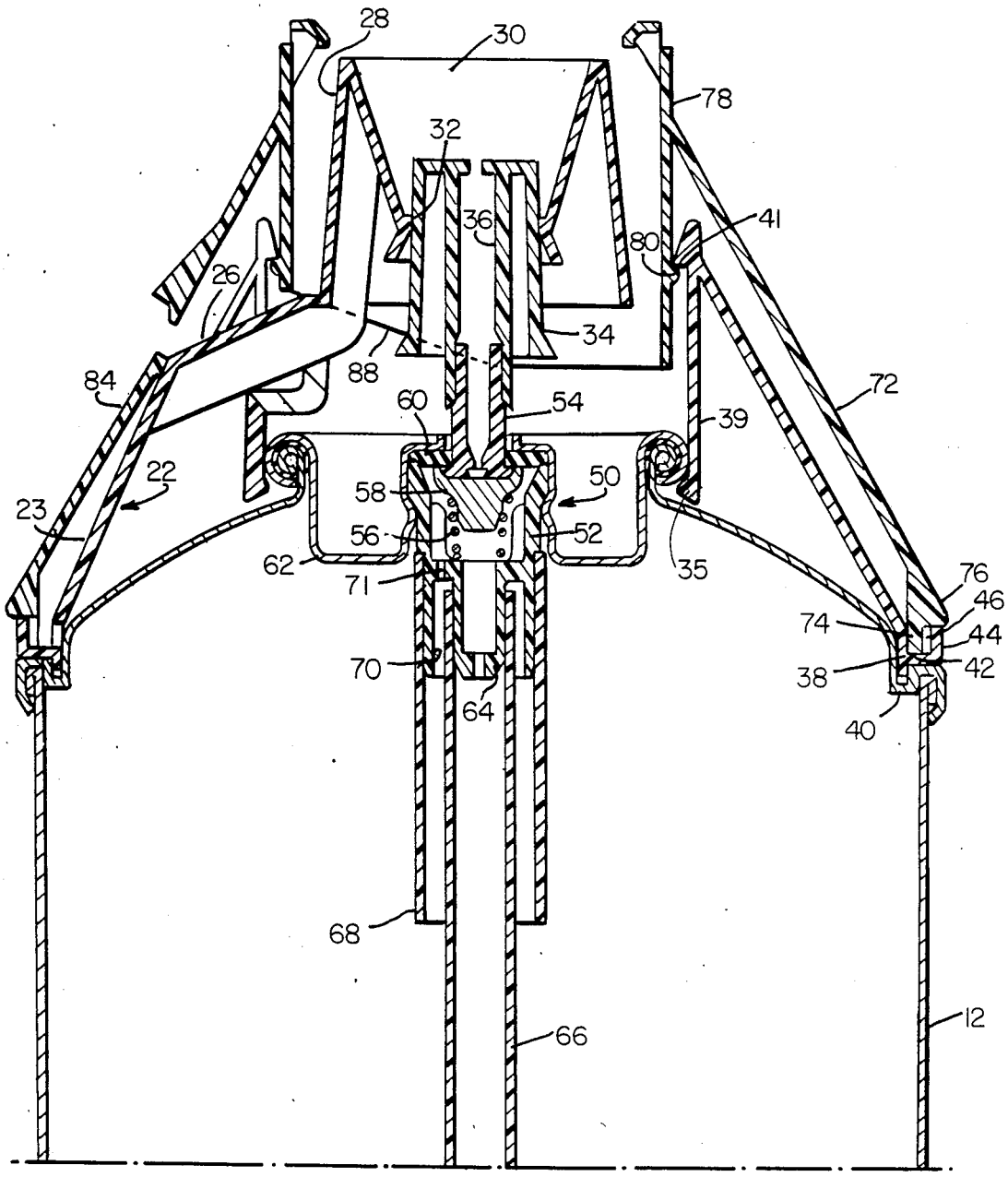
FIG. 3 is a cross-sectional view taken along the line 3—3 of FIG. 1, and on an enlarged scale relative thereto)

As best shown in FIGS. 2 and 3, the operating member 22 includes an upwardly and inwardly inclined second surface 26 joining the lower end of an outer conical member 28 that merges at its upper end with an inner, inverted conical member 30 defining at its lower, narrow end an aperture 32 for frictionally supporting a nozzle 34, such as a fogging nozzle, having a central tubular portion 36 normally axially aligned with the longitudinal axes of the container 12 and actuator 14.

The lower region of the conical wall of the cap 16 merges with a short, depending, annular wall 38 (FIG. 3) adapted frictionally to engage a recessed rim 40 of a conventional aerosol container 12 to provide rotational resistance for cap 16 during actuation for continuous operation, to be described later. An annular flange 42 extends outwardly of the median region of the wall 38 and merges with an upstanding flange 44 to define a recess 46 between the wall 38 and the flange 44, for a purpose later to be described. A tubular element 39 depends from the upper end of the cap 16; and an annular, inwardly extending radial shoulder 41 is provided at the juncture of the outer wall of the cap and the tubular element 39, also for a purpose later to be described.

A tubular element 39 depends from the upper end of the cap 16; and an annular, inwardly extending radial shoulder 35 (FIG. 3) is formed at its distal end frictionally to engage the outer surface of a portion of a mounting cup 62 which is crimped to the top of the container side wall.

The container 12 may carry a preassembled valve assembly 50 of known, conventional type as shown and described in U.S. Pat. No. 4,475,667 incorporated herein by reference.

Figure 4:
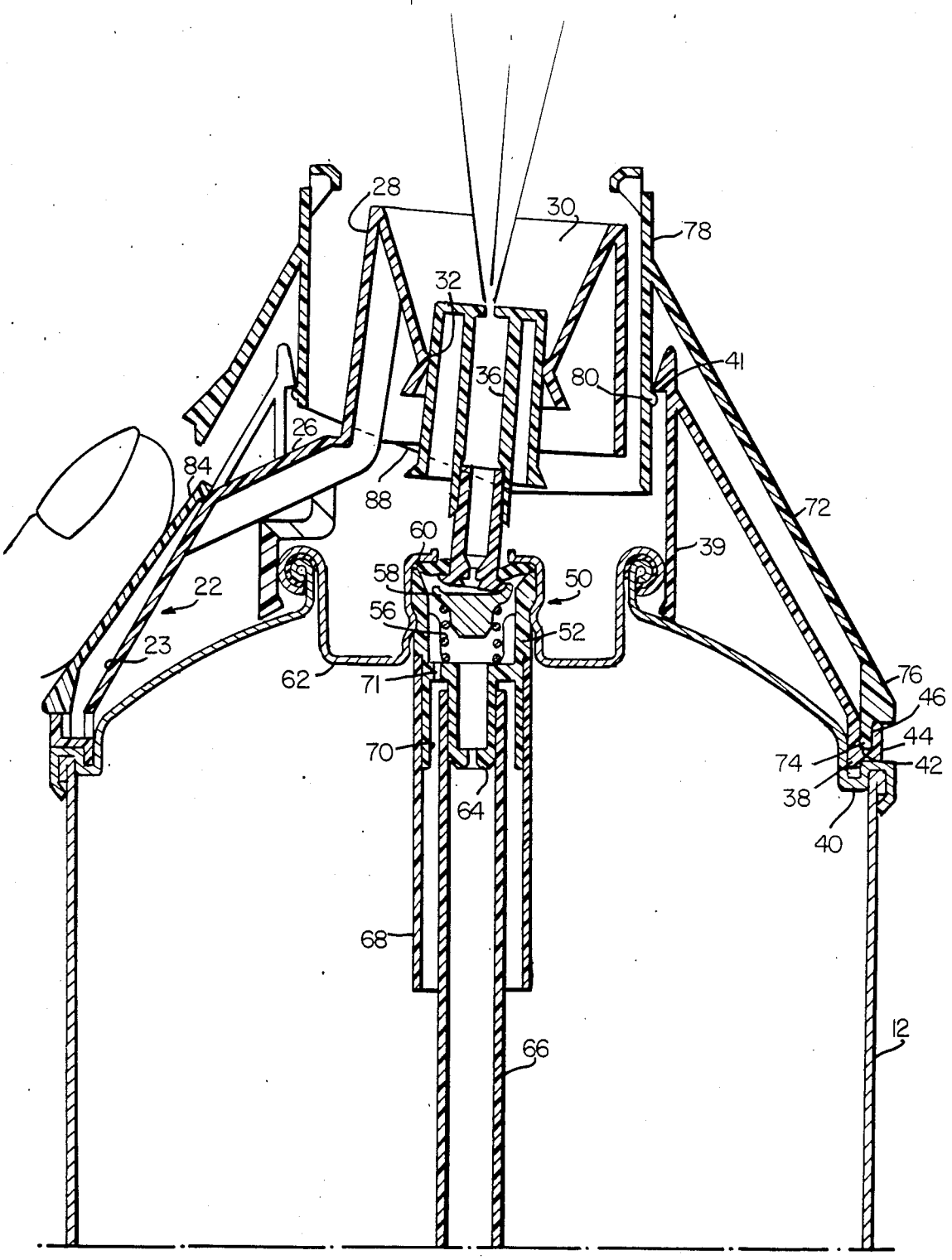
FIG. 4 is a view similar to FIG. 3 but illustrating the actuator in one mode of discharge operation.
Figure 5:
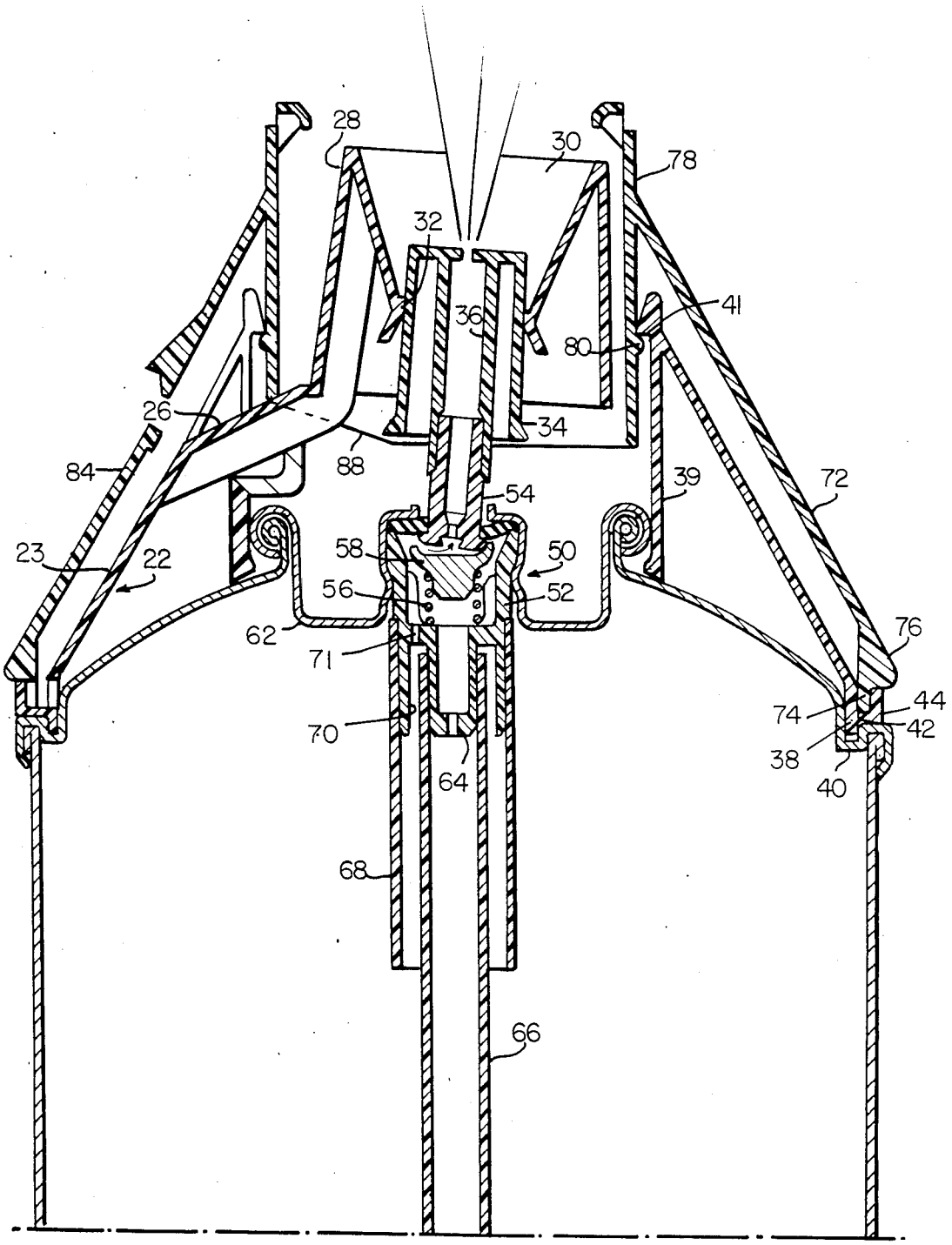
FIG. 5 is a view similar to FIG. 4 but illustrating the actuator in another mode of discharge operation.

Briefly stated, the valve assembly includes a body 52, a valve stem 54 adapted frictionally to be received in the lower end of the nozzle 34, and a valve closing spring 56 which biases a seat 58 against a gasket 60 to seal the interior of the body from the exterior except when the valve is operated as by moving the nozzle 34 to the position shown in FIGS. 4 and 5 by the application of a force to either of the first or second operating member surfaces 23 or 26.

The valve body 52 defines a hollow interior and is coupled to a mounting cup 62 which is in turn crimped to the container side wall.

The body 52 terminates in a ported tailpiece 64 adapted to mount a dip tube 66 and an auxiliary tube 68 communicating through ports 70, 71 with the valve stem 54 when the valve is open as in FIGS. 4 and 5. A ball (not shown) is carried in the dip tube 66 to close the central port in the tailpiece when the unit is operated in inverted position so that inverted discharge will terminate when the level of product reaches the end of the auxiliary tube, as clearly explained in U.S. Pat. No. 4,475,667.

From the description thus far it will be seen that the cap 16 may be frictionally mounted to the upper end of the container 12 and that the application of an inwardly directed radial force to the first surface 23 of the operating member 22 or a downwardly directed force applied to the second surface 26 of that member, will cause the same resiliently to pivot about hinges 24, 24 causing the conical member 28 to move downwardly in an arc to tilt the nozzle 34 and thus the valve stem 54 to allow discharge of the container contents.

To permit valve opening by either the first or second mode of operation, i.e. intermittent or continuous operation, the overcap 18 is adapted to be mounted over the cap 16; and to this end it is preferably also formed with a conical wall 72 terminating at its lower end in an annular, vertical wall 74 that rests within the recess 46 and frictionally engages the exterior surface of the wall 38 of cap 16 while a protruding annular lip 76 abuts the end of flange 44.

The upper end of the wall 72 merges with a vertically disposed tube 78, part of which depends from the wall 72 inwardly of the tubular element 39 of cap 16. An annular bead 80 on the outer surface of the tube 78 engages the shoulder 41 to assist in maintaining the cap 16 and overcap 18 in assembled relation. The wall 72 is also formed with a recess 82 in which a button or trigger 84 is pivotally mounted to the wall 72 at its lower region by hinges 86, 86 (FIG. 2). A portion of the lower surface of the tube 78 is ramped upwardly as at 88 (FIGS. 3, 4, 5) along an annular distance of the order of about 75° from a point about 90° from the vertical centerline of the recess 82 (FIG. 2) to a point slightly past the recess.

To assemble the overcap 18 to the cap 16, the overcap is positioned over the cap with the recesses 20 and 82 in vertical alignment. The overcap is then pressed down towardI the cap until the wall 74 enters the recess 46 and frictionally engages the wall 38, the protrusion 76 engages the flange 44 and the bead 80 snaps into position under the shoulder 41. The cap and overcap are thus secured together against easy separation, but it will be noted that they are rotatable relative to one another.

To open the valve for intermittent or on demand operation, the trigger 84 is simply depressed by finger pressure as in FIG. 4, causing it to bear against the surface 23 of operating member 22 thus to tilt the nozzle 34 and valve stem 54 into position to open the valve. Upon release of the finger pressure, the parts return to their original position by reason of the resilience of spring 56 and hinges 24 and 86.

To open the valve for continuous operation, the overcap 18 is rotated relative to cap 16 in the direction of an arrow which may be embossed in its outer surface, to cause the ramp 88 to engage the surface 26 of the operating member 22 and cam the same downwardly to achieve the same valve opening effect as with the first operational mode. However, in this case, the valve will remain open so long as the overcap 18 remains in its rotated position. To allow the valve to close, the overcap is rotated in a reverse direction to its original position whereupon the valve closes under the influence of the spring 56 and the operating member returns to its normal position due to the resilience of hinges 24.

Figure 8:
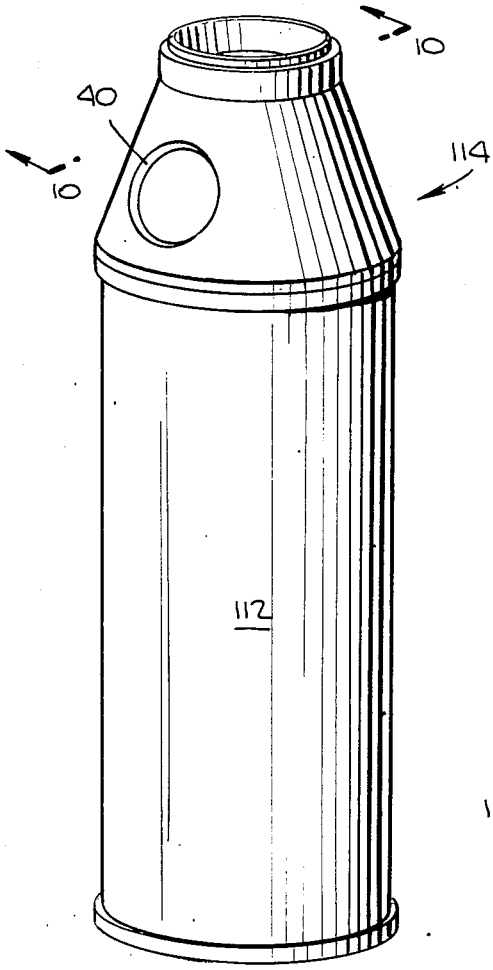
FIG. 8 is an elevational view similar to FIG. 1 but illustrating another embodiment of the present invention.

FIGS. 8 to 14 illustrate another and preferred form of the invention wherein an actuator 114 is shown in FIG. 8 as mounted on a container 112, the actuator being constituted by a cap 116 mountable on the container 112 and an overcap 118 mountable on the cap 116 much the same way as in the previously described embodiment.

Figure 9:
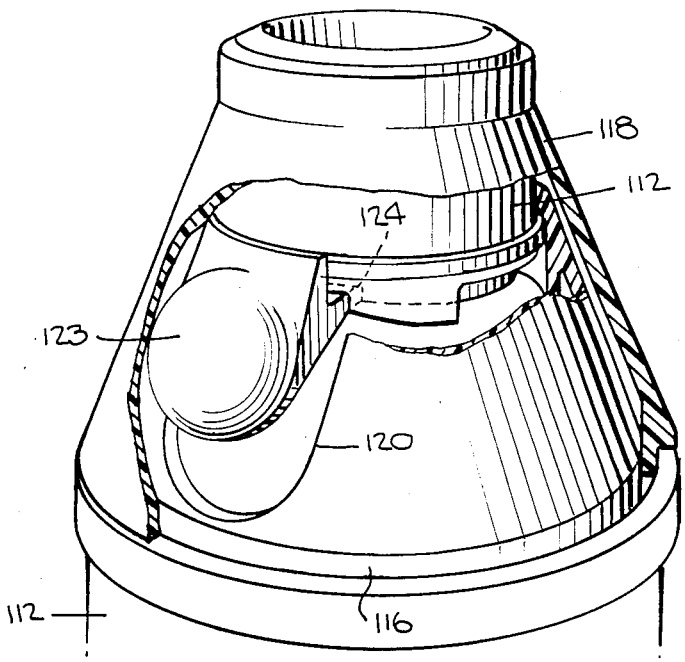
FIG. 9 is a fragmentary elevational view illustrating the cap and overcap of the embodiment of FIG. 8 and on an enlarged scale relative thereto)
Figure 13:
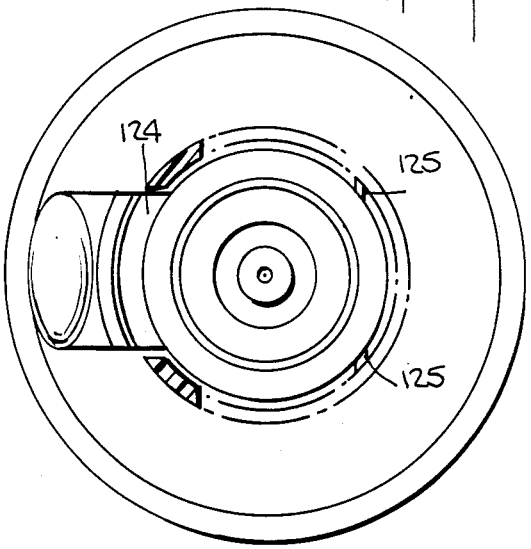
FIG. 13 is a top plan view (on a relatively slightly reduced scale relative to FIG. 9), partly broken away and illustrating the apparatus in normal position.
Figure 14:
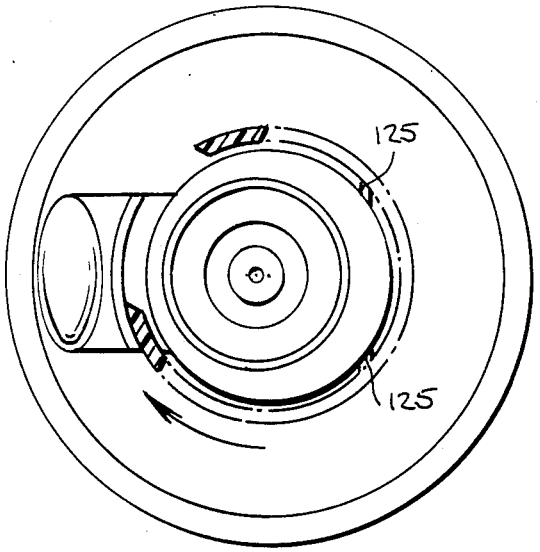
FIG. 14 is a view similar to FIG. 13 but illustrating the apparatus in one operational mode.

The cap 116 is generally conical in form and is provided with a recess 120 extending from its upper rim downwardly to a region near its lower rim, as shown in FIG. 9; and an operating member 122 having a circular button or trigger 123 is integral with the member 122 through a rigid, lateral extension 124. The operating member is connected to the interior surface of the cap 116 by a pair of integral extensions 125 that serve as hinges, whereby the operating members may be pivoted about the axes of the extensions or hinges 125, relative to the remainder of the cap, upon the application of a radial force to the trigger 123. The elements described thus far are formed of semi-rigid plastic, the nature of which is such that its inherent resiliency returns the operating member 122 to its normal position when the operating force is released.

Figure 10:
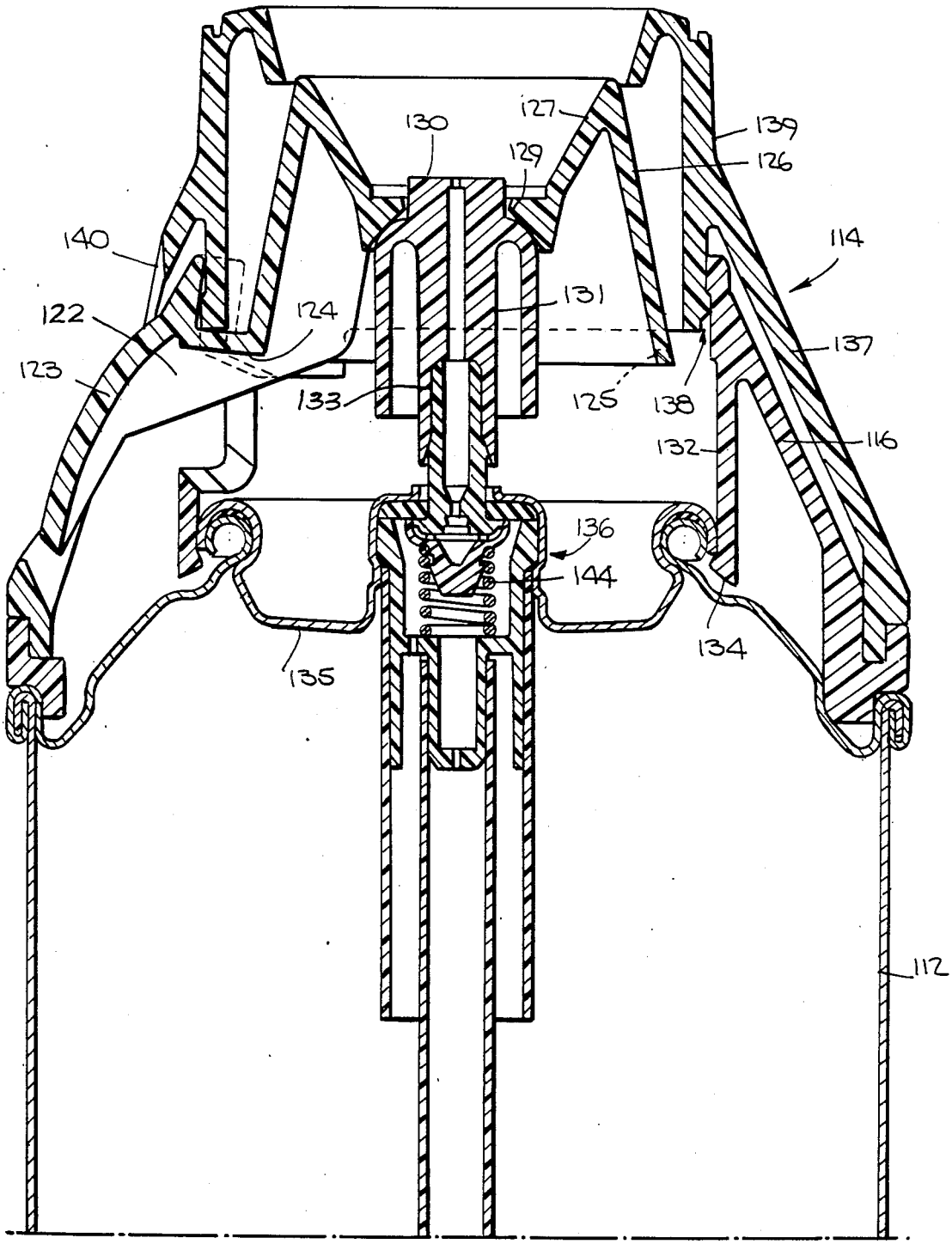
FIG. 10 is a cross-sectional view taken along the line 10—10 of FIG. 8 (on an enlarged scale relative thereto) and illustrating the various parts in normal position.

As best shown in FIG. 10, the operating member 122 may take the form of an outer conical member 126 that merges at its upper end with an inner, inverted conical member 127 defining, at its lower, narrow end an aperture 129 for frictionally supporting a nozzle 130, such as a fogging nozzle having a central tubular portion 131 normally axially aligned with the longitudinal axes of the container 112 and actuator 114.

A tubular element 132 (FIGS. 10 and 12 ) depends from the upper end of the cap 116; and an annular, inwardly extending radial shoulder 134 is formed at its distal end frictionally to engage the outer surface of a portion of a mounting cup 135 which is crimped to the top of the container side wall.

The container 112 may carry a preassembled valve assembly 136 of the type referred to in the description of the first embodiment of the invention and as shown and described in U.S. Pat. No. 4,475,667.

The valve assembly dip tube and auxiliary tube and associated parts are as already described in connection with the embodiment of FIGS. 1 to 7.

From the description thus far it will be seen that the cap 116 may be frictionally mounted to the upper end of the container 112 and that the application of an inwardly directed force to the trigger 123 of the operating member 122, or a downwardly directed force applied to the extension 124, will cause the operating member to pivot about the axes of hinges 125 causing the conical member 126 to move downwardly in an arc to both tilt and depress nozzle 130 and thus the valve stem 133 to allow discharge of the container contents in the manner as previously described.

To permit valve opening by either of two modes of operation, i.e intermittent or continuous operation, the overcap 118 is adapted to be mounted over the cap 116 and, to this end, it is also formed with a conical wall 137 engaging the cap 116 as already described.

Figure 12:
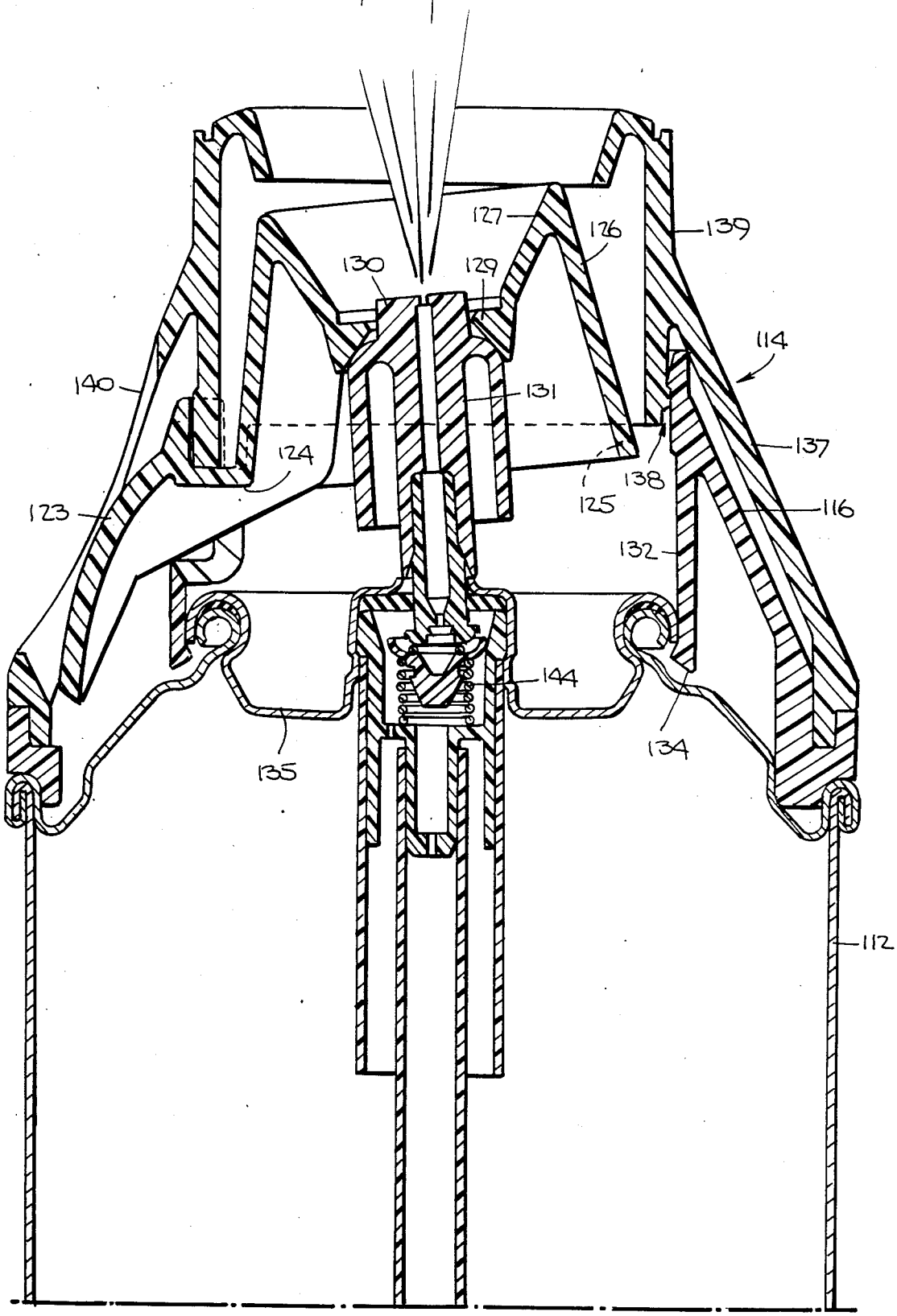
FIG. 12 is a view similar to FIGS. 10 and 11 but illustrating a second mode of valve actuation.

The upper end of the wall 137 merges with a vertically disposed tube 139, part of which depends from the wall 137 inwardly of the tubular element 132 of the cap 116 to which it is connected by a snap joint 138 (FIGS. 10 and 12).

The wall 137 is formed with an aperture 140 (FIG. 10) through which the button or trigger 123 slightly projects and the lower, distal end of the tube 139 is provided with a pair of depending cams 142 (FIG. 11), one on each side of the aperture 140, these cams being ramped downwardly in a direction away from their most adjacent ends.

Figure 11:
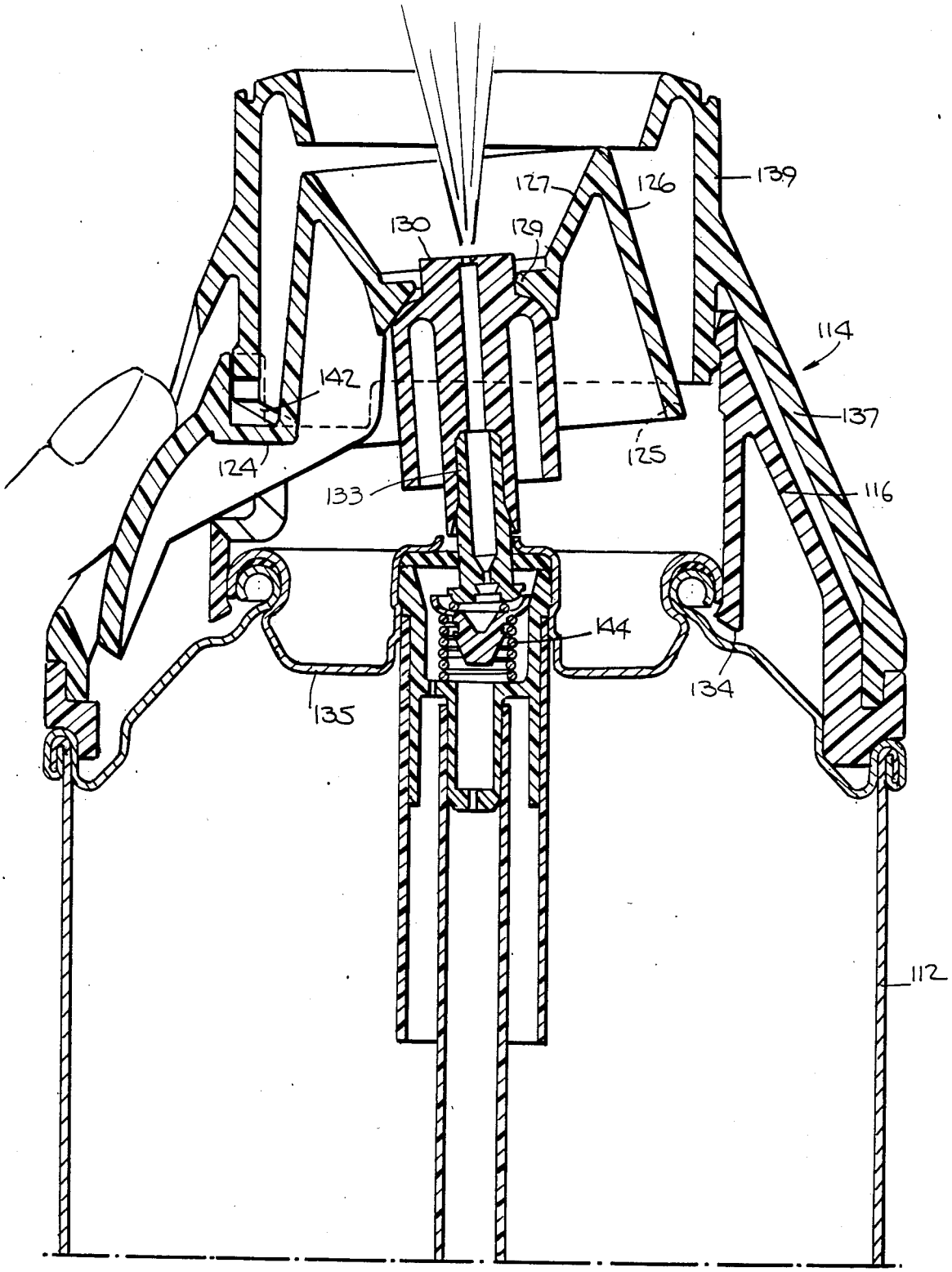
FIG. 11 is a view similar to FIG. 10 but illustrating one mode of valve actuation.

To open the valve for intermittent or on demand operation, the trigger 123 is simply depressed by finger pressure as in FIG. 11, causing the extension 124 and the conical member 126 to pivot about the axes of hinges 125 whereupon the surface that defines the aperture 129 at the lower end of the inverted conical member 127 tilts the nozzle 130 and valve stem 133 into the shown position (i.e. FIG. 11) to open the valve. Upon release of the finger pressure, the parts return to their original position by reason of the resilience of spring 144 and hinges 125.

To open the valve for continuous operation, the overcap 118 is rotated in either direction relative to cap 116 to cause the ramp of one of the cams 142 to engage the upper surface of the extension 124 and cam the same downwardly to achieve the same operating effect as in the case of the intermittent or on demand mode of operation. However, as in the case of the device of the embodiment of FIGS. 1 to 7, the valve will remain open so long as the overcap 118 remains in its rotated position. To allow the valve to close, the overcap is rotated in a reverse direction to its original position, whereupon the valve closes under the influence of the spring 144; and the operating member 122 (FIG. 10) returns to normal position due to resilience of the hinges 125.

It will be noted that the extent of permissible rotation of the overcap 118, in either direction is limited by the fact that, depending on the direction of rotation, the active cam 142 (FIG. 11) will abut the most adjacent hinge when the operating member is cammed to full operating position 122.

We believe that the construction and operation of our novel valve actuator will now be understood and that the several advantages thereof will be fully appreciated by those persons skilled in the art.

We claim:

1. A valve actuator for use with an aerosol container and comprising:

a cap mountable on the discharge end of the container and having a movable operating member adapted to shift a valve member carried by the container from normal valve closed position to open position to allow discharge of the container contents; and actuator means supported exterior of said cap for movement relative thereto and having a surface for engaging and operating said operating member as said actuator means is moved from a first to a second position, wherein said surface on said actuator means is inclined relative to a surface of said operating member to cam the same into valve opening position when said actuator means is moved from said first position to said second position and to release said operating member when said actuator means is moved from said second position to said first position, whereby said operating member can be manually shifted into said valve opening position when said actuator means is in said first position and whereby said operating member remains in said valve opening position so long as said actuator means is in said second position.

2. An actuator according to claim 1, wherein said actuator means comprises an overcap mounted for rotation relative to said cap and about the longitudinal axis of said container.

3. An actuator according to claim 1, wherein said actuator means includes a pair of surfaces for engaging and operating said member, said surfaces being disposed one on each side of said surface of said operating member whereby said operating member is cammed to valve opening position upon rotation of said actuator means in either annular direction from its normal position.

4. An actuator according to claim 1, wherein said actuator means comprises an overcap mounted for rotation relative to said cap and about the longitudinal axis of said container and a lever pivotably mounted to said actuator means for engagement with said operating member when said actuating means is in said first position.

5. An actuator according to claim 1, wherein said actuator means comprises an overcap mounted for rotation relative to said cap and about the longitudinal axis of said container and a manually accessible button integral with said operating member when said actuating means is in said first position.

6. An actuator according to claim 4 or 5, wherein said cap is connected to said operating member by hinge means adapted resiliently to bias said operating member to valve closing position.

7. A valve actuator for use with an aerosol container and comprising:

a cap mountable on the discharge end of the container and having an operating member pivotably connected thereto and adapted to shift a valve member carried by the container from normal valve closing position to open position to allow discharge of the container contents, said cap being formed with an upstanding annular exterior surface; and an overcap having an upstanding annular interior surface adapted frictionally to engage said exterior cap surface to support said overcap exterior of said cap and to permit annular movement of said overcap relative to said cap, said overcap having a cam surface for engaging and operating said operating member as said overcap is moved annularly from a first to a second position relative to said cap;

whereby said operating member remains in valve opening position so long as said overcap is in said second position.

8. An actuator according to claim 7, wherein said overcap is provided with a tubular member depending from its upper interior region and said cam surface is formed on the lower end of said tubular member, said cam surface being inclined relative to a surface of said operating member to cam the same to valve operating position when said overcap is moved from said first position to said second position and to release said operating member when said overcap is moved from said second to said first position.

9. An actuator according to claim 7, wherein said overcap is provided with a tubular member depending from its upper interior region and a pair of cam surfaces are formed on the lower end of said tubular member, said cam surfaces being inclined relative to a surface of said operating member to cam the same to valve operating position when said overcap is rotated in either direction about the axis of the container from said first position to said second position and to release said operating member when said overcap is moved from said second to said first position.

10. An actuator according to claim 7 or 8, wherein said overcap includes a manually operable trigger operable to shift said operating member into valve operating position when said overcap is in said first position.

11. An actuator according to claim 7 or 9, wherein said operating member is provided with a manually accessible trigger operable to shift said operating member into valve operating position when said overcap is in said first position.

12. An actuator according to claim 10, wherein said trigger is constituted by a lever pivotally mounted to said overcap for engagement with said operating member when said overcap is in said first position.

13. An actuator according to claim 8 or 9, wherein said operating member is formed with means for supporting a nozzle adapted to engage a valve stem carried by said container so as to receive and control discharge of the container contents when said operating member is in valve opening position.

14. An actuator according to claim 12 wherein said operating member is formed with means for supporting a nozzle adapted to engage a valve stem carried by said container so as to receive and control discharge of the container contents when said operating member is in valve opening position.

* * * * *